US010156080B1

(12) United States Patent
Speaks

(10) Patent No.: US 10,156,080 B1
(45) Date of Patent: Dec. 18, 2018

(54) BOAT WORK PLATFORM SYSTEM AND CORRESPONDING METHODS

(71) Applicant: Joaquin Speaks, Ansonia, CT (US)

(72) Inventor: Joaquin Speaks, Ansonia, CT (US)

( * ) Notice: Subject to any disclaimer, the term of this patent is extended or adjusted under 35 U.S.C. 154(b) by 0 days.

(21) Appl. No.: 15/661,704

(22) Filed: Jul. 27, 2017

(51) Int. Cl.
*E04G 3/28* (2006.01)
*B63B 17/00* (2006.01)

(52) U.S. Cl.
CPC ..... *E04G 3/28* (2013.01); *B63B 17/00* (2013.01)

(58) Field of Classification Search
CPC ..... E04G 3/28; E04G 1/22; E04G 1/34; B66F 11/04; B66F 11/042; B66F 11/046; B66F 7/065; B66F 3/36; B63B 17/00; E06C 5/04; A01D 46/20; B05B 13/04
USPC ..... 114/221 R, 343, 364; 248/229.12, 248/229.22, 228.3, 230.3, 231.41, 229.14, 248/229.24, 228.5, 230.5, 231.61, 228.1; 108/145, 149, 116–120, 144.11, 147, 108/147.19, 147.2, 147.22; 224/497; 182/159, 180.3
See application file for complete search history.

(56) References Cited

U.S. PATENT DOCUMENTS 795,451 A * 7/1905 Rice ..... A47L 3/02 182/129
1,351,053 A 10/1919 Macklem
1,949,820 A * 3/1934 Timmons ..... A47L 3/02 182/113
2,003,581 A * 6/1935 Daly, Jr. ..... E04G 1/22 108/116
2,059,739 A * 11/1936 Ment ..... A47L 3/02 182/152
2,412,158 A * 12/1946 Kuehlman ..... B64F 1/32 108/145
2,420,635 A * 5/1947 Workman ..... A47L 3/02 182/61
2,669,733 A * 2/1954 Picker ..... B63B 27/14 114/264
2,721,718 A * 10/1955 Wagner ..... A01K 97/05 248/214
2,805,103 A * 9/1957 Casimer ..... A47L 3/02 182/113
3,490,558 A 1/1970 Foley
4,062,519 A * 12/1977 Jacobs ..... A63C 19/06 160/331
4,130,178 A * 12/1978 Smith, Jr. ..... B66F 3/22 182/141
4,221,280 A * 9/1980 Richards ..... B66F 7/065 187/269
4,341,375 A * 7/1982 Romanin ..... B25B 1/103 269/153
4,343,379 A * 8/1982 Haulotte ..... B66F 7/0625 182/141
4,405,116 A * 9/1983 Eisenberg ..... B66F 7/0608 182/141

(Continued)

OTHER PUBLICATIONS http://www.nauticexpo.com/prod/freestyle-cruiser/product-49268-403017.html.

*Primary Examiner* — Colleen M Chavchavadze
*Assistant Examiner* — Shiref M Mekhaeil
(74) *Attorney, Agent, or Firm* — UConn IP Clinic

(57) ABSTRACT

The platform includes a base support that can be clamped to a boat railing and extendable support arms that support a work platform. Methods of manufacturing the platform are also disclosed.

16 Claims, 7 Drawing Sheets

(56) References Cited

U.S. PATENT DOCUMENTS 4,466,509 A * 8/1984 Kishi ..... B66F 11/042 182/141
4,522,000 A * 6/1985 Barari ..... E02D 27/34 248/228.3
4,697,775 A * 10/1987 Wille ..... A01K 97/10 248/214
4,821,393 A * 4/1989 Spigarelli ..... B23Q 3/183 269/224
5,139,110 A * 8/1992 Kishi ..... B66F 11/042 182/141
5,339,749 A * 8/1994 Hirose ..... B23Q 1/5468 108/137
5,375,681 A * 12/1994 Eickmann ..... B66B 9/04 187/237
6,053,284 A 4/2000 Fountain
6,651,775 B2 * 11/2003 Bassett, Jr. ..... B66F 11/042 182/69.5
6,758,585 B1 * 7/2004 Chan ..... F16M 11/10 248/164
7,066,102 B1 * 6/2006 Tossavainen ..... B63B 21/00 114/230.1
7,814,843 B2 10/2010 Chen et al.
8,312,966 B1 * 11/2012 Guthrie ..... E04G 5/045 182/3
8,424,643 B1 * 4/2013 Speaks ..... B63B 17/00 182/180.3
8,500,098 B2 * 8/2013 Li ..... B66F 7/14 254/100
8,517,413 B2 * 8/2013 Chen ..... B25H 1/04 248/370
8,910,970 B2 * 12/2014 Chen ..... B25H 1/04 280/652
9,206,941 B2 * 12/2015 Smith ..... F16M 11/04
9,802,295 B2 * 10/2017 Zhang ..... B25B 5/145
2008/0053750 A1 * 3/2008 Tseng ..... A62B 1/02 182/82
2008/0115701 A1 * 5/2008 Sugiura ..... B25H 1/04 108/132
2011/0017120 A1 * 1/2011 Fafard ..... B63B 29/02 114/343
2011/0155505 A1 * 6/2011 Liang ..... A62B 35/0081 182/3
2013/0068803 A1 * 3/2013 Brodeur ..... A47G 25/88 223/113

* cited by examiner

BOAT WORK PLATFORM SYSTEM AND CORRESPONDING METHODS

BACKGROUND

The present embodiments described herein are generally directed to ladders and scaffolds. More specifically, the present embodiments herein pertain to portable work platforms.

There are great needs for a portable platform support system designed to provide a stable and safe working platform with variable working heights, especially for working on boats. During the repair or cleanup of a boat superstructure, and particularly during body work such as waxing, it often arises that workers need easy, safe access to the upper part of the boat structure. By the way of example, when cleaning a superstructure of a boat, it is often very difficult to clean the top portion of the structure owing to the fact that no convenient platform or other means is provided giving the worker proper access. This difficulty can be particularly pronounced in the case of taller boats. In attempting to work on hard-to-reach areas such as upper area of the superstructure, workers may cause damage to other portions of the boat or may cause injury to themselves.

Currently, working on the surface of the superstructure of a boat has been done with step ladders and scaffolds. Conventional ladders are of limited utility in boat environments because step ladder rungs will normally be perpendicular to the boat superstructure surface, leading workers to turn their bodies to work on the boat structure while standing on the ladder platform. This will put workers in a very unnatural and unsafe position. Workers can certainly entertain the idea of employing scaffolding on the deck. However, this method is expensive and is not ideal on a narrow path like the boat deck between the structure and railing. Due to this narrow deck area between the superstructure and boat railing, some workers resort to suspending themselves from the top of the structure using a rope. These customary methods of working on high superstructure of boats have been found to be inefficient and unsafe. From the above, it is therefore seen that there exists a need in the art to overcome the deficiencies and limitations described herein and above.

SUMMARY

The embodiments described herein provide a portable work platform system configured to be removably mounted on a railing of a boat, the system comprising a base support having a first base component, a second base component, a first top surface and a second top surface; a clamping mechanism connecting the first base component to the second base component and being configured to connect the base support to the railing; and at least two extendable support arm systems each having a first bottom end, a second bottom end, a first top end and a second top end. Each of the first bottom ends connects to the first top surface and each of the second bottom ends connects to the second top surface. The system also comprises a generally horizontal work platform having a primary surface, a first bottom surface and a second bottom surface, with the first bottom surface connecting to each extendable support arm systems' second top end. The primary surface is configured to support a surface of the boat.

In one embodiment the extendable support arm system further comprises a primary extendable support link having a first bottom end, a first top end, a first support surface and a second support surface. The first bottom end connects to the first top surface and the first top end connects to the first bottom surface. This embodiment further comprises a primary non-extendable support link having a second bottom end and a middle endpoint. The second bottom end connects to the second top surface and the middle endpoint connects to the second support surface. The support arm system further comprises a secondary support link having a first endpoint and a second top end. The first endpoint connects to the first support surface and the second top end connects to the second bottom surface.

Another embodiment provides a system, comprising a boat having a railing and a wall, a portable work platform system configured to be removably mounted on the railing. The work platform of the system comprises a base support having a first base component, a second base component, a first top surface, and a second top surface. The work platform system further comprises a clamping mechanism. The clamping mechanism connects the first base component to the second base component and is configured to connect the base support to the railing. The work platform system further comprises at least two extendable support arm systems each having a first bottom end, a second bottom end, a first top end and a second top end. Each of the first bottom ends connect to the first top surface and each of the second bottom ends connect to the second top surface. The system also comprises a generally horizontal work platform having a primary surface, a first bottom surface and a second bottom surface. The first bottom surface connects to each extendable support arm systems' first top end, the second bottom surface connects to each extendable support arm systems' second top end and the primary surface is configured to support an individual to work on a surface of said boat.

In another embodiment the base support of the system further provides a first component inner surface and second component inner surface each having at least one gland on an inner surface. The system further comprises, a first detachable spacer and a second detachable spacer each having at least one flexible outer ridge. The first detachable spacer and second detachable spacer are configured to attach to the first component inner surface and the second component inner surface by aligning the outer ridge(s) with the gland(s).

A further embodiment is a method of preparing a portable work platform system. The method comprises providing a base support having a first component, a second component, a first top surface and a second top surface. The first top surface has at least two first clevis mounts attached and the second top surface has at least two second clevis mounts attached. Then, the method further comprises providing a clamping mechanism. The clamping mechanism is configured to connect the first component to the second component. The clamping mechanism is positioned to allow the first component to move towards the second component and the first component to move away from the second component. The method further comprises providing at least two extendable support arm systems. Each extendable support arm system has a primary extendable support link, a primary non-extendable support link, and a secondary extendable support link. The support arm systems are positioned to connect the primary extendable support links to be removably mounted to the first clevis mounts and to be removably mounted to the primary non-extendable support arm systems to the second clevis pins. The method further comprises providing a first platform component in fixed contact with the primary extendable support arms and a second platform component removably mounted with the secondary extendable support arm; and positioning the extendable support arm systems and first and second platform components to allow a user to stand on the second platform component during use.

Additional features and advantages are realized through the techniques of the present invention. Other embodiments and aspects of the invention are described in detail herein and are considered a part of the claimed invention.

The recitation herein of desirable objects which are met by various embodiments of the present invention is not meant to imply or suggest that any or all of these objects are present as essential features, either individually or collectively, in the most general embodiment of the present invention or in any of its more specific embodiments.

BRIEF DESCRIPTION OF THE DRAWINGS

The subject matter which is regarded as the invention is particularly pointed out and distinctly claimed in the concluding portion of the specification. The invention, however, both as to organization and method of practice, together with the further objects and advantages thereof, may best be understood by reference to the following description taken in connection with the accompanying drawings in which:

DETAILED DESCRIPTION

The present disclosure describes a portable work platform system that can, for example, be removably mounted to a boat railing, vary in height by utilizing the extendable support arm system, and provide a safe platform for an individual to stand on while cleaning, painting, or otherwise modifying a boat superstructure surface. While using the term "boat superstructure surface" to represent the application of the system described herein, any surface which could be otherwise hard to reach without this portable work platform system is also intended to be included in the term "boat superstructure surface."

Figure 1:
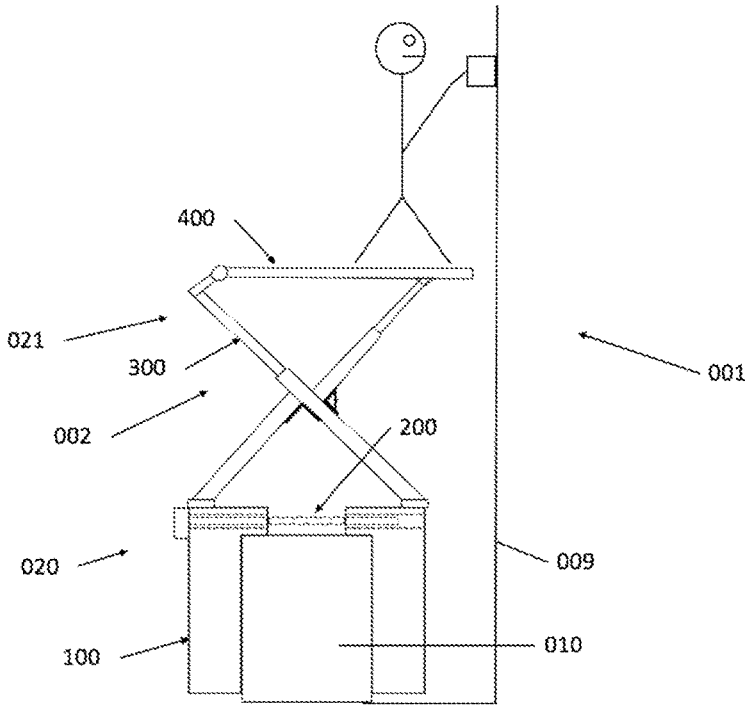
FIG. 1 schematically depicts a fully functioning portable work platform system according to a first embodiment of the system disclosed herein.

As shown in FIG. 1, a system, from a front view, according to an initial embodiment is depicted. In this embodiment, the system comprises a boat 001 and a portable work platform system 002. The portable work platform system further comprises an attachment structure 020 and a support structure 021. The attachment structure 020 comprises a base support 100 and a clamping mechanism 200. The support structure 021 comprises at least two extendable support systems 300 and a generally horizontal work platform 400. In this embodiment, the support structure 021 can be removed from the attachment structure 020, so they can be transported more easily. Additionally, the boat comprises a railing 010 and a boat superstructure surface 011. The system is configured such that the clamping mechanism 200 secures the base support 100 by compressing the base support 100 against the railing 010. This fixes the portable work platform in place and allows an individual to step up onto the railing 010 of the boat 001 and then onto the generally horizontal work platform 400, where his or her weight is distributed over the extendable support systems 300 and the base support 100.

The boat to be used with this system is typically in the 55 foot to 79 foot range. This size of boat may have narrow walkways between the railing and the boat superstructure surface, and therefore may not have enough room for a ground engaging work platform to be configured. The railing, which the disclosure is mounted to, is typically between about 6" and about 18" and the device can accommodate varying railing widths.

Figure 2:
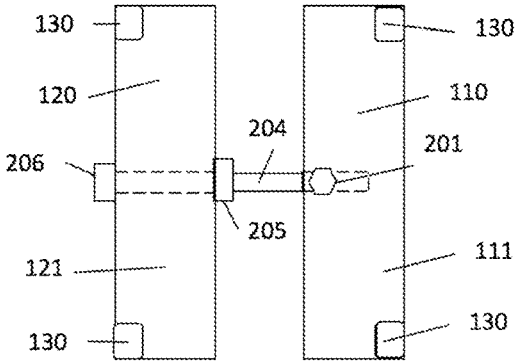
FIG. 2 depicts a top view of a base support of a portable work platform according to the first embodiment of the system disclosed herein.
Figure 3:
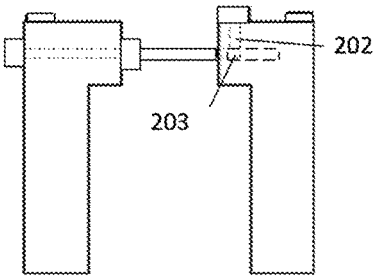
FIG. 3 depicts a front view of the base support of FIG. 2.
Figure 4:
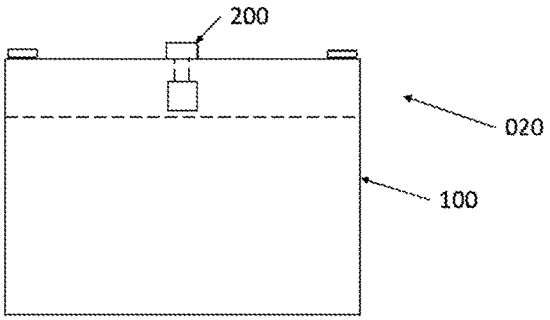
FIG. 4 depicts a side view of the base support of FIG. 2.

In FIG. 2-FIG. 4 top, front, and side views of the attachment structure 020 are depicted according to the work platform system 002 of FIG. 1. As shown in FIG. 4, a side view of the attachment structure 020, the structure comprises a base support 100 and a clamping mechanism 200.

As shown in FIG. 2, a top view of the attachment structure 020, the base support 100 comprises a first base component 110 and a second base component 120, wherein at least two base clevis mounts 130 are fixed to the first top surface 111 of the first base component 110 and at least two base clevis mounts 130 are fixed to the second top surface 121 of the second base component 120. The positioning of the clevis mounts is a design choice, which accounts for weight distribution and simplifying folding the support structure 021 from FIG. 1 upon detachment from clevis mounts 130. As shown in FIG. 2 and FIG. 3, the first base component 110 and second base component 120 are then connected by the clamping mechanism 200, wherein the clamping mechanism comprises a worm shaft 201, a worm 202, a worm wheel 203, a bolt 204, a nut 205 and a bolt head 206.

The attachment structure functions to (1) provide a secure and steady attachment to the boat railing and (2) to provide a wider base for the load to be distributed over when the device is in use. The base support 100 may be manufactured from marine grade aluminum, graphite, HDPE, or any other suitable material known in the art. The clamping mechanism 200 may be a worm screw mechanism, a bolted joint mechanism, a bar clamp mechanism, or any other suitable clamping mechanism known within the art. The purpose of the clamping mechanism is to provide pretension to the base support, which secures the base support to the railing. The clamping mechanism can be made from steel, nickel, aluminum, or any other suitable material known in the art.

A worm screw mechanism is well known within the art, and can be used as a gear system to allow an individual to turn the worm shaft 201 clockwise which results in the following sequence of events: (1) the worm shaft 201 spins the worm 202 along its center axis; (2) the worm 202 spins the worm wheel 203 along its center axis, said axis being generally perpendicular to the worm 202; (3) the worm wheel 203 pulls the bolt 204; and (5) the bolt 204 pulls the bolt head 206, which in turn pulls the second base component 120 towards the first base component 110. The nut 205 is generally flush with the first side 122 of the second base component 120 and the bolt head 206 is generally flush with the second side 123 of the second base component. Thus, turning the worm shaft 201 counter clockwise reverses the prior course of events and results in the nut 205 pushing against the first side 122 and expanding the base components in order to, for example, dismount the base support 100 from the railing 010. The bolt must have at least one threaded portion. There must be a threaded portion to interface with the nut 205 allowing the nut to be torqued into place to secure the bolt to the second base component 120. Additionally there must be a threaded portion to interface with the worm wheel 203, wherein the worm wheel 203 has an inner hole that is threaded with a mating thread, allowing the spinning of the worm wheel to move the bolt 204 along its axis in a direction dependent upon the direction the worm shaft is turned. These threaded portions on the bolt can be the same thread size and extend from the first side 122 to the end of the bolt 204 past the worm wheel 203. Alternatively, the threaded portions can differ at the nut interface 205 and the worm wheel interface 203 depending on how much torque is desired for the base support 100.

Figure 5:
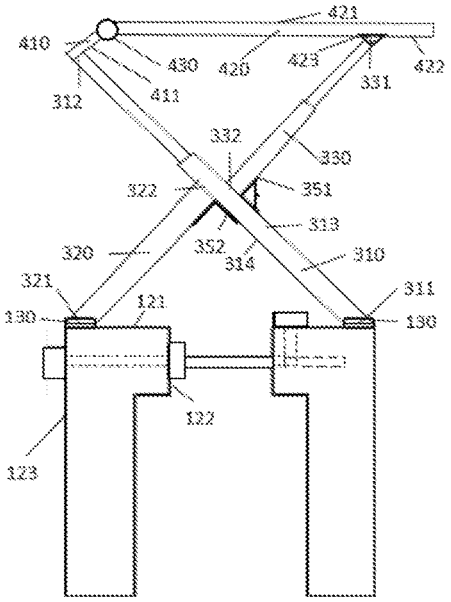
FIG. 5 depicts a front view of a portable work platform according to the work platform system of FIG. 1.
Figure 6:
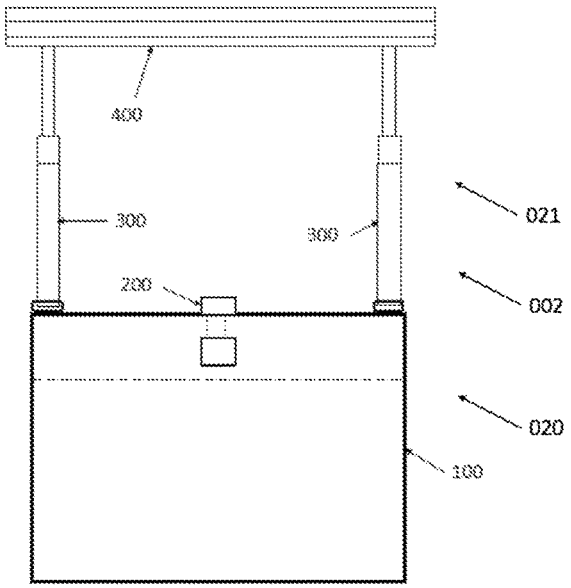
FIG. 6 depicts a side view of the portable work platform of FIG. 5.

FIG. 5 and FIG. 6 show a front view and side view of the portable work platform system 002 comprising, an attachment structure 020 and support structure 021, as depicted in FIG. 1. As shown in FIG. 6, the support structure 021 comprises at least two extendable support arm systems 300 and a generally horizontal work platform 400. As shown in FIG. 5, each support arm system comprises a primary extendable support link 310, a primary non-extendable support link 320, and a secondary extendable support link 330. Each primary support link 310 is detachably mounted at its first bottom end 311 to a base clevis mount 130. Each primary non-extendable support link 320 is detachably mounted at its second bottom end 321 to a base clevis mount 130. The primary non-extendable support link 320 also has a middle endpoint 322 which connects to the primary extendable support arm on its secondary support surface 314 by a first hinge 352, which may or may not be rounded. There is secondary support link 330 having a first endpoint 332 which connects to the primary extendable support link 310 on its primary support surface 313 by utilizing a snap latch 351 or the like. The primary extendable support link 310 is then rigidly, or detachably, attached at its first top end 312 to the first platform component 410 at its first bottom surface 411. The secondary extendable support link 330 is rigidly, or detachably, mounted at its second top end 331 to a platform clevis mount 423 on the second bottom surface 422 of the second platform component 420. The generally horizontal work platform 400 comprises a first platform component 410 that is connected by a second hinge 430 to the second platform component 420. The primary surface 421 of the second platform component 420 is configured to be generally horizontal to allow an individual to work on a generally perpendicular surface, such as a boat superstructure surface 011 as in FIG. 1.

The extendable support arm system 300 and generally horizontal work platform 400 may also be manufactured from marine grade aluminum, graphite, HDPE, or any other material known in the art. In embodiments, the extendable support arms comprise nested concentric square tubes, or nested concentric circular tubes. The inner tubes are able to be slideably adjusted and may utilize a gear rack system to lock the inner tube in place to provide an individual with a platform at the desired height. The extendable support arms may also use a pin system in order to lock the inner tubes in place. The pin system comprises holes at varying intervals of the inner tubes and a single corresponding set of holes on the outer tubes, wherein the inner tubes height can be locked in place by aligning the desired interval of the inner tube with the corresponding set of holes on the outer tube and locking a pin in place. These systems for adjusting extendable support arms are well known within the art.

Figure 7:
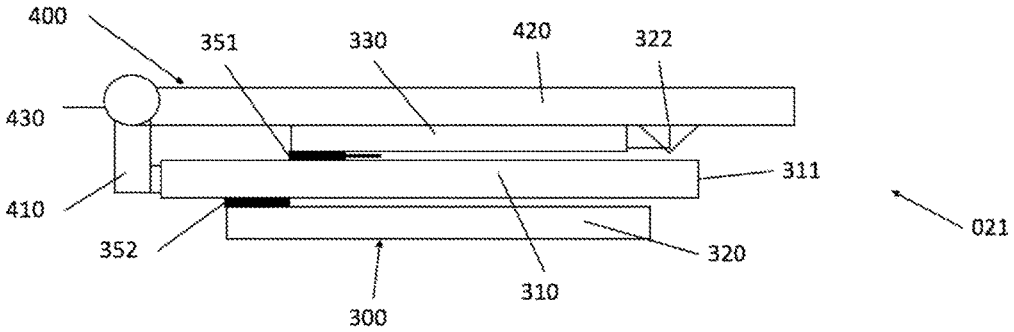
FIG. 7 depicts a front view of the support structure of the work platform of FIG. 5 in a folded configuration.

In FIG. 7, support structure 021 comprising, at least two support arm systems 300 and a generally horizontal work platform 400 is depicted in its foldable and portable form. The support arm systems 300 are detached from the clevis mounts 130 completely isolating the support structure 021 from the attachment structure 020 of FIGS. 1, 4 and 6. The primary extendable support link 310 is shortened to its limiting height, the primary non-extendable support link 320 is folded towards the first bottom end 311 by the first hinge 352. The secondary extendable support link is then shortened to its limiting height, while simultaneously folding the second platform component 420 about its second hinge 430. The snap latch 351 is unsnapped allowing the secondary support link 330 to fold generally parallel with the primary support link 310. The result is an easily portable support structure 021.

Figure 8:
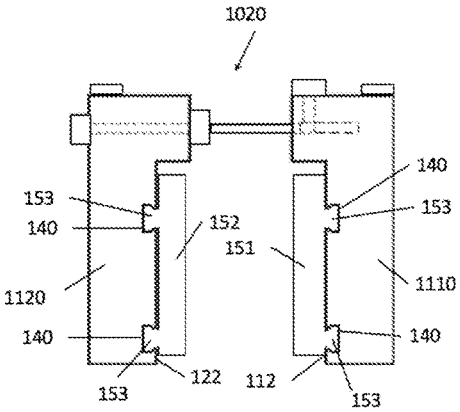
FIG. 8 depicts a front view of an attachment structure according to a second embodiment of the system disclosed herein.
Figure 9:
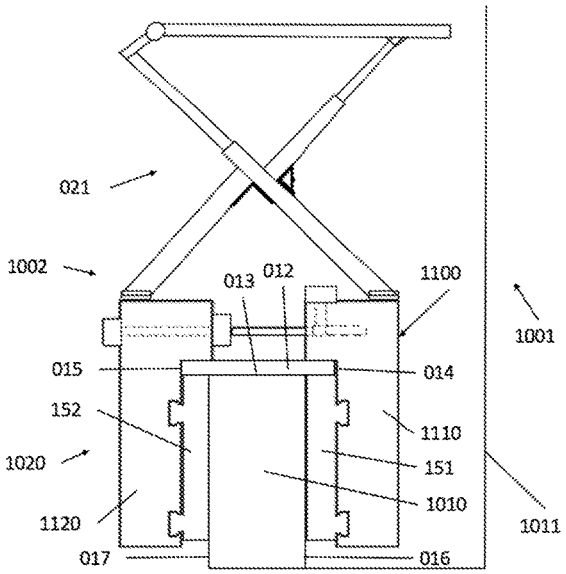
FIG. 9 depicts a front view of a boat railing and portable work platform according to second embodiment of the system disclosed herein.

In FIGS. 8 and 9, a second embodiment of a portable work platform is shown and is designated as 1002. In FIG. 8, an attachment structure 1020 is depicted separate from the second work platform embodiment 1002. In the attachment structure 1020, the first component inner surface 112 of the first base component 1110 has one or more diverging glands 140 and the second component inner surface 122 of the second base component 1120 also has one or more diverging glands 140. Although two diverging glands 140 are depicted on each surface, it is intended that one or more glands may be manufactured on the first component inner surface 112 and second inner surface 122. These glands 140 are designed to fix a first detachable spacer 151 to the first base component 1110 and the second detachable spacer 152 to the second base component 1120. The first detachable spacer 151 and second detachable spacer 152 have one or more outer ridges 153 that align, and are equal in number, with the diverging glands 140 of first base component 1110 and second base component 1120. The first and second detachable spacers are made of a flexible compressible material, such as a thermoplastic polymer, for example high density polyethylene foam, a thermoset material, such as silicone rubber. This allows the outer ridges to compress and fit through the glands and then expand once through the glands fixing the spacers in place.

The configuration of FIGS. 8 and 9 are designed to account for an alternative boat configuration 1001 with a varying railing design. Some boats have a cap 012 that is attached on the top end 013 of the railing 010, wherein said cap 012 is wider than the railing 010. To account for the space between the first railing surface 016 and the first cap edge 014, the first detachable spacer 151 fills the gap. Similarly, the second detachable spacer 152 fills the gap between the second railing surface 017 and the second cap edge 015. The first base component 1110 and second base component 1120 are able to distribute the structural load across the base support 1100 and railing 1010 under this configuration since the detachable spacers are compressed between the railing 1010 and first base component 1110 and second base component 1120. Additionally, the portable work platform 1020 is secured to the railing 1010, providing a stable work surface for an individual to work on the boat superstructure 1011.

Figure 10:
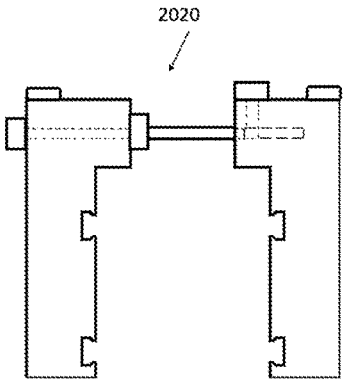
FIG. 10 depicts a front view of an attachment structure according to a third embodiment of the system disclosed herein.
Figure 11:
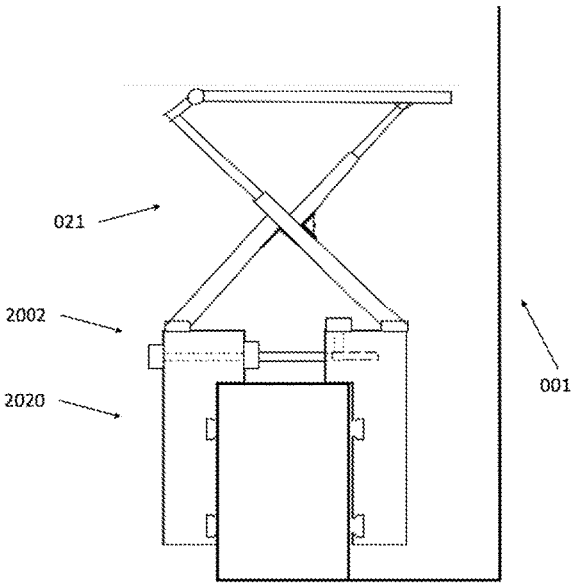
FIG. 11 depicts a front view of a boat railing and portable work platform according to the third embodiment of the system disclosed herein.

In FIGS. 10 and 11, a third embodiment of a portable work platform system is shown and designated as 2002. In FIG. 10, an attachment structure 2020 is depicted separate from the third work platform embodiment. In this attachment structure 2020, the first detachable spacer 151 and second detachable spacer 152 are removed from attachment structure 1020 from FIGS. 8 and 9 are removed creating an attachment structure 2020. The configuration of FIGS. 10 and 11 are adaptive to the original boat 001 as depicted in FIG. 1.

Figure 12:
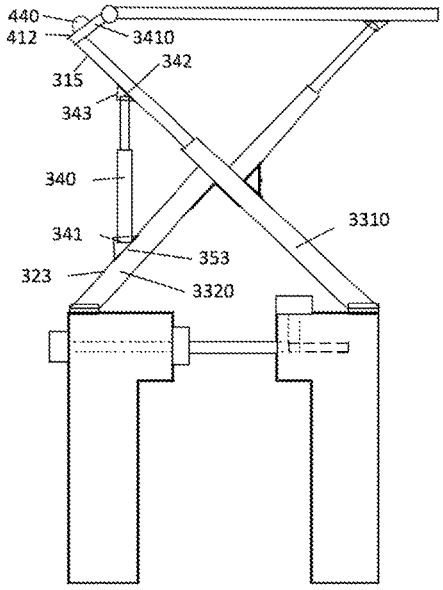
FIG. 12 depicts a front view of a portable work platform according to a fourth embodiment of the system disclosed herein.
Figure 13:
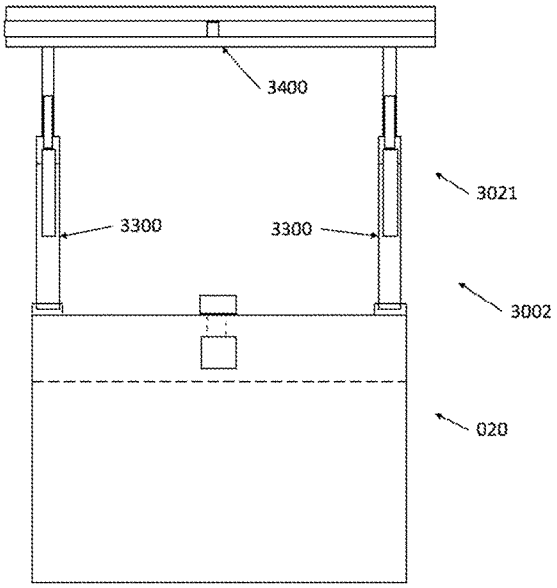
FIG. 13 depicts a side view of the portable work platform of FIG. 11.

In FIG. 12 and FIG. 13, a portable work platform system 3002 according to a fourth embodiment is depicted. This portable work platform system comprises, an alternative support structure 3021 and the original attachment structure 020. This configuration is designed to provide additional structural support to an individual working on a generally horizontal work platform 3400. The alternative support structure 3021 comprises at least two alternative support arm systems 3300 and an alternative generally horizontal work platform 3400. The alternative support structures 3300 are the original support structures 300 further comprising a middle extendable support link 340. The middle extendable support link 340 has a bottom endpoint 341, which is connected to the primary non-extendable support link 3320 on its third support surface 323 by a first link clevis 353 and a top endpoint 342 fixedly attached to a second link clevis 354, which is removably mounted to the fourth support surface 315 of the primary extendable support link 3310. The middle extendable support link 340 provides an additional structural load path for an individual working on the generally horizontal work platform 3400. The generally horizontal work platform 3400 in this embodiment is the original generally horizontal work platform 400 further comprising one or more metal eye brackets 440 fixedly attached on the secondary surface 412 of the first component 4410. The one or more metal eye brackets 440 are meant to provide a user with an attachment point for a harness. This would provide a user with a safety mechanism in case the user fell off the portable work platform 3002.

Figure 14:
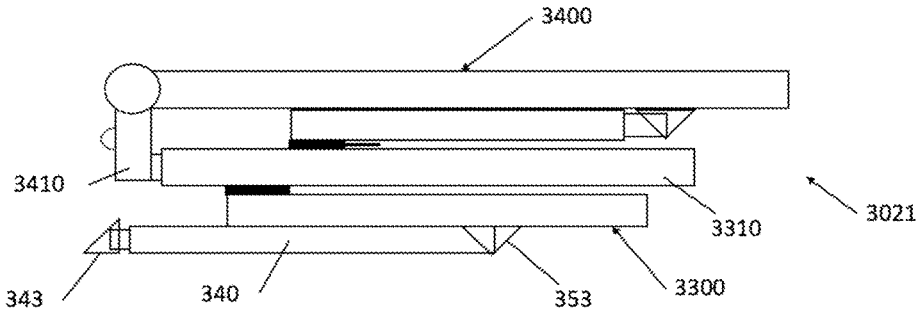
FIG. 14 depicts a front view in a folded configuration of the support structure of the portable work platform of FIG. 12.

In FIG. 14, the alternative support structure 3021 comprising at least two alternative support structures 3300 and a generally horizontal work platform 3400 from FIG. 11 and FIG. 12 is depicted in its foldable and portable form. The alternative support structure 3021 folds according to the original support structure 021 as in FIG. 7 with the addition of the middle extendable support link 340 further folding about the first link clevis 353 towards the first platform component 3410 and resulting in the middle extendable support link 340 being generally parallel with the primary extendable support link 3310. As shown in FIG. 14, the link clevis mount fully detaches from the primary extendable support link 4310 to allow the primary extendable support link 4310 to shorten to its same limiting height from the original attachment structure 021 embodiment.

Figure 15:
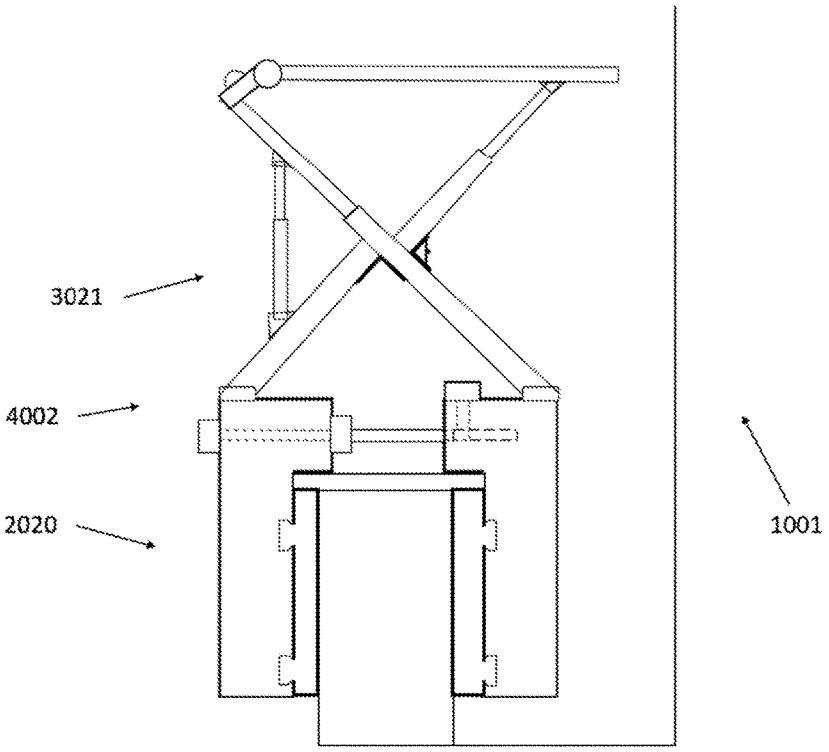
FIG. 15 depicts a front view of a boat railing and portable work platform according to a fifth embodiment of the system disclosed herein.

In FIG. 15, a system comprising a fourth embodiment of a portable work platform system 4002 and the alternative boat configuration 1001 is depicted. This portable work platform system 4002 combines the support structure 3021 from FIGS. 12-14 with the attachment structure 1020 from FIGS. 8-9. This portable work platform system 4002 is meant to demonstrate that any attachment structure described herein can be mixed and matched with any support structure described herein, and although all combinations may not be depicted, it is understood that any combination of support structure and attachment structure is disclosed herein. The portable work platform 4021 is desirable for its safety features, adaptability to various railing designs, additional support, while remaining foldable and portable.

Figure 16:
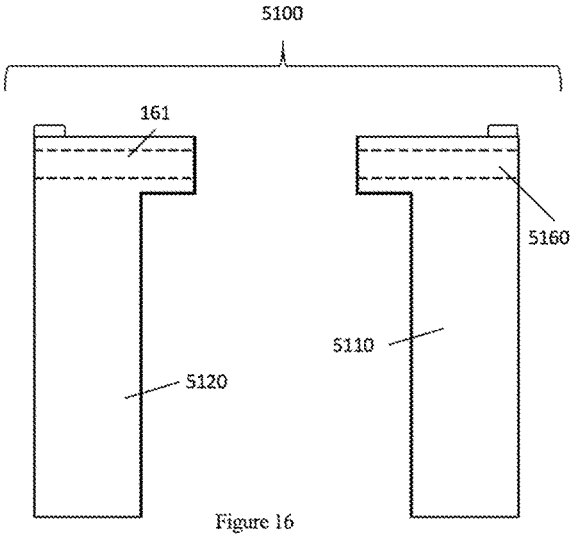
FIG. 16 depicts a front view of a base support according to a sixth embodiment of the system disclosed herein.
Figure 17:
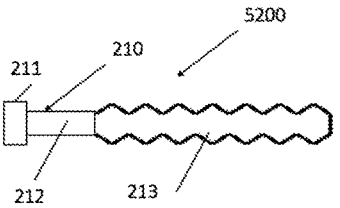
FIG. 17 depicts a front view of a clamping mechanism according to the sixth embodiment of the system disclosed herein.
Figure 18:
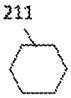
FIG. 18 depicts a side view of the clamping mechanism in FIG. 17.

In FIGS. 16-18, an alternative base support 5100 and an alternative clamping mechanism 5200 are depicted. FIG. 17 shows a front view and FIG. 18 shows side view of the alternative clamping mechanism 5200. The alternative base support 5100 is configured to have a threaded through hole 160 on the first base component 110 and a standard bolt hole 161 through the second base component 5120 as depicted. The clamping mechanism 5200 is simplified from the previous worm screw mechanism configuration to comprise a standard bolt 210. The standard bolt 210 comprises a head 211, a shaft 212, and a threaded section 213. The threaded section 213 has a male thread that mates with the threaded through hole 160 and is commonly known in the art. Since the clamping mechanism 5200 can be removed from the base support 5100, this embodiment simplifies carrying the base support because an individual can stack the first base component 5110 and second base component 5120 when transporting this alternative base support 5100.

Figure 19:
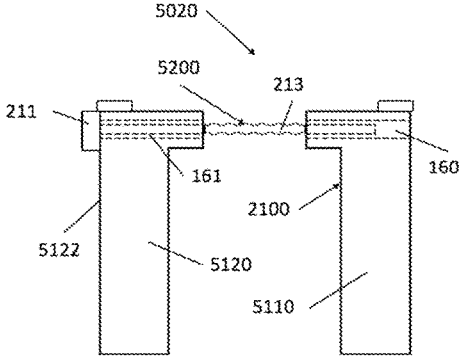
FIG. 19 depicts an attachment structure configured to include the clamping mechanism of FIG. 17 and base support of FIG. 16 according to the sixth embodiment of the system disclosed herein.

FIG. 19 shows attachment structure 5020 comprising the alternative clamping mechanism 5200 and a base support 5100 as separately depicted in FIGS. 16-18. The attachment structure 5020 connects the first base component 5110 and second base component 5120 by placing the standard bolt 210 through the bolt through hole 161 and into the threaded through hole 160 by torqueing the bolt head 211 in the clockwise direction so that the threaded section 213 of the standard bolt 210 engages the threaded through hole 161 and the bolt head 211 applies a force to the second outer surface 5122.

Figure 20:
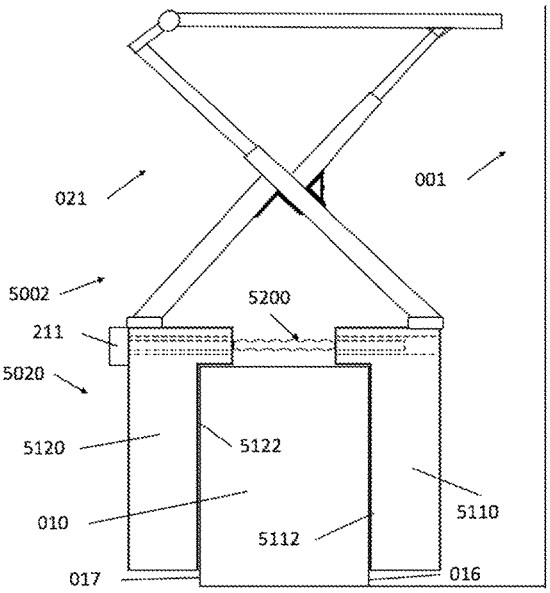
FIG. 20 depicts a front view of a portion of a base support of a portable work platform according to a sixth embodiment of the system disclosed herein.

As shown in FIG. 20, a system comprising a sixth embodiment of a portable work platform system 5002 and the original boat configuration 001 is depicted. The portable work platform system 5002 comprises an attachment structure 5020, as depicted in FIG. 19, and the original support structure 021, as depicted in FIG. 1 and FIG. 3. In this embodiment, the head 211 of the bolt standard bolt 210 is torqued, creating a pretension in the standard bolt 210 of the clamping mechanism 5200, and equal and opposite forces at the interface between the first railing surface 016 and first inner surface 5112 of the first base component 5110 and equal and opposite forces at the interface between the second railing surface 017 and the second inner surface 5122 of the second base component 5120 securing the attachment structure 5020 about the railing 010, and providing a secure base for the support structure 021.

Figure 21:
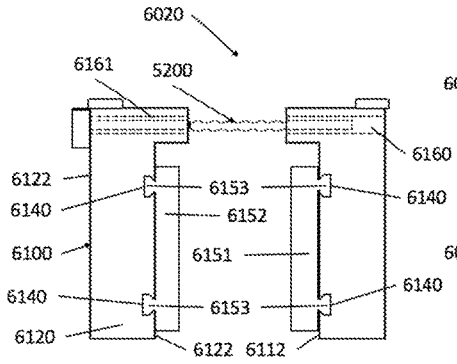
FIG. 21 depicts a front view of a portable work platform according to a seventh embodiment of the system described herein.

In FIG. 21, the alternative attachment structure 6020 comprising the alternative clamping mechanism 6200 and yet another alternative base support 6100 is depicted. The base support 6100 comprises a first component 6110 with one or more grooves 6140 on its first inner surface 6112, a second component 6110 with one or more grooves 6140 on its second inner surface 6112, a first detachable spacer 6151 and second detachable spacer 6152 configured with outer ridges 6153 that align with the grooves 6140 on the first inner surface 6112 and second inner surface 6122, a threaded through hole 6160 generally horizontal through the first base component 6110, and a standard bolt hole 6161 generally horizontal through the second base component 6120 as depicted. The clamping mechanism 6200 is configured as it is in FIG. 19-20 to provide force to the second outer surface 6122 and engage the threaded through hole 6160.

Figure 22:
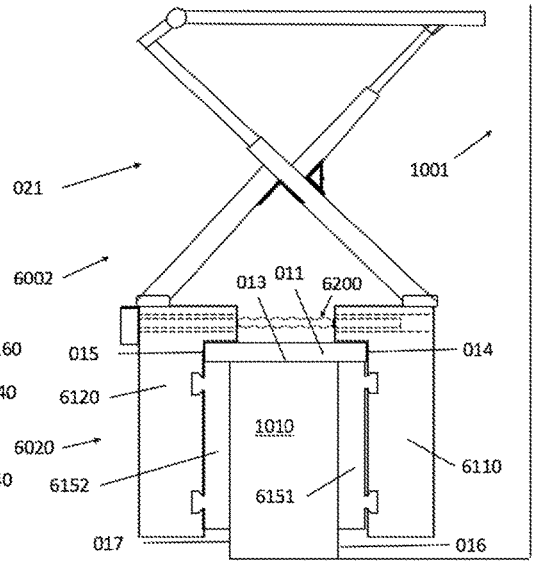
FIG. 22 depicts a side view of the portable work platform in FIG. 21.

As shown in FIG. 22, a system comprising a seventh embodiment of a portable work platform system 6002 and a boat 1001 is depicted. The portable work platform system 6002 comprises an attachment structure 6020, as depicted in FIG. 21, and an original support structure 021, as depicted in FIG. 1 and FIG. 3. In this embodiment, the clamping mechanism 6200 is torqued, creating a pretension in the clamping mechanism 6200, and creating equal and opposite forces at the interfaces between (1) the first inner surface 6112 of the first base component 6110 and the first detachable spacer 6151; (2) the first detachable spacer 6151 and the first railing surface 016; (3) the second inner surface 6122 of the second base component 6120 and the second detachable spacer 6152; and (4) the second detachable spacer 6152 and the second railing surface 017. The reaction forces between the attachment structure 6020 and railing 010 secure the portable work platform system 6002 to the boat 1001 and provide a solid base for the support structure 021.

Figure 23:
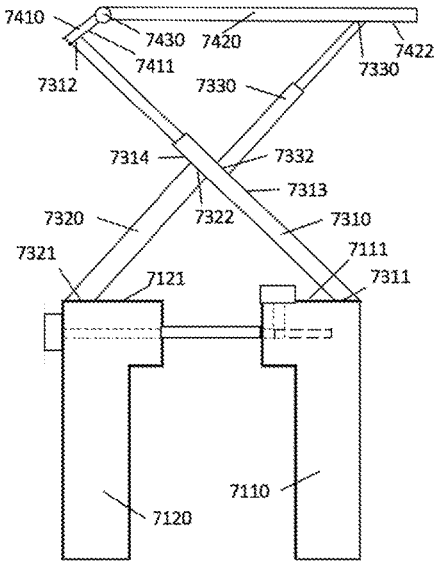
FIG. 23 depicts a front view of a portable work platform according to an eighth embodiment of the system described herein.
Figure 24:
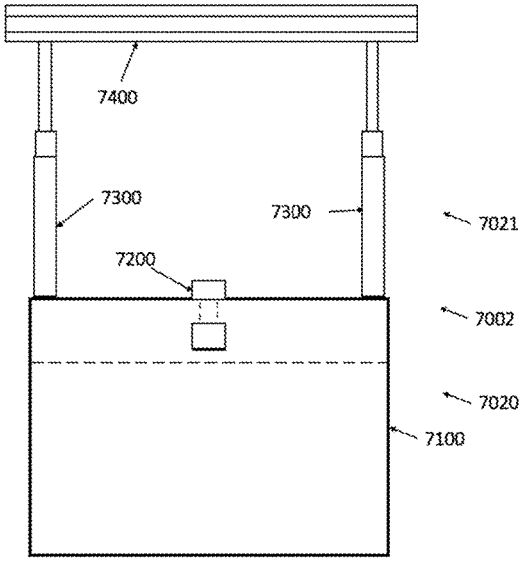
FIG. 24 depicts a side view of the portable work platform in FIG. 23.

In FIG. 23 and FIG. 24, a front view and side view of an eighth embodiment of a portable work platform system 7002 comprising an alternative attachment structure 7020 and an alternative support structure 7021 is depicted. The alternative attachment structure 7020 comprises an alternative base support 7100 and the original clamping mechanism 7200, wherein the alternative base support 7100 has rigid attachment points on its first top surface 7111 of its first base component 7110 and on its second top surface of its second base component 7120 as opposed to detachable clevis mount supports 130 from the original attachment structure 020, as depicted in FIG. 2. The alternative support structure 7021 comprises at least two alternative support link systems 7300 and an alternative generally horizontal work platform 7400. The alternative support link systems 7300 comprises of fixed attachments at the first bottom end 7311 to first top surface 7111 interface, the second bottom end 7321 to second top surface 7121 interface, the middle endpoint 7322 to second support surface 7314 interface, the first endpoint 7332 to first support surface 7313 interface, the first top end 7312 to first bottom surface 7411 interface, and the second top end 7331 to second bottom surface 7422 interface. The alternative generally horizontal work platform 7400 is similar to the original generally horizontal work platform 400 without the platform clevis mount 423, and instead having a rigid attachment at the second top end 7331 to second bottom surface 7422 interface.

The preferred embodiment has a base support 100 made from High Density Polyethylene, a clamping mechanism 200 made from marine grade aluminum, at least one support structure made from marine grade aluminum, and a horizontal work platform made from marine grade aluminum.

While the embodiments described herein have been described in detail in accordance with certain preferred embodiments thereof, many modifications and changes therein may be effected by those skilled in the art. Although not all of the various combinations of attachment structures and support structures were depicted for the portable work platform system, it is understood the resulting portable work platform from any combination of attachment structure and support structure is disclosed herein. Accordingly, it is intended by the appended claims to cover all such modifications and changes as fall within the spirit and scope of the embodiments described herein.

I claim:

1. A portable work platform system configured to be removeably mounted on a railing of a boat, the system comprising:

a base support having a first base component, a second base component, a first top surface and a second top surface;

a clamping mechanism, said clamping mechanism connecting said first base component to said second base component and being configured to connect said base support to said railing;

at least two extendable support arm systems each having a first bottom end, a second bottom end, a first top end and a second top end, wherein each of said first bottom ends connect to said first top surface and each of said second bottom ends connect to said second top surface; and a generally horizontal work platform having a primary surface, a first bottom surface and a second bottom surface, wherein said first bottom surface connects to each extendable support arm systems' first top end, said second bottom surface connects to each extendable support arm systems' second top end and said primary surface being configured to support an individual to work on a surface of said boat.

2. The portable work platform system of claim 1, wherein each extendable support arm system further comprises:

a primary extendable support link comprising said first bottom end, said first top end, a first support surface and a second support surface, wherein said first bottom end connects to said first top surface and said first top end connects to said first bottom surface;

a primary non-extendable support link comprising said second bottom end and a middle endpoint, wherein said second bottom end connects to said second top surface and said middle endpoint connects to said second support surface;

a secondary support link comprising a first endpoint and said second top end, wherein said first endpoint connects to said first support surface and said second top end connects to said second bottom surface.

3. The portable work platform system of claim 2, wherein each extendable support arm system further comprises a first hinge connecting said middle endpoint to said second support surface and a latch connecting said first endpoint to said first support surface.

4. The portable work platform system of claim 3, wherein said generally horizontal work platform further comprises a first platform component and a second platform component and a second hinge, wherein said first platform component is attached to said second platform component by the second hinge; the first hinge, the latch and the second hinge allowing said primary non-extendable support link, said secondary support link and said second platform component to fold adjacent to said primary extendable support link when detached from said base support.

5. The portable work platform system of claim 2, wherein said base support comprises:

a first component inner surface and second component inner surface each having at least one gland on said inner surface;

a first detachable spacer and a second detachable spacer each having at least one flexible outer ridge, wherein said first detachable spacer and second detachable spacer are configured to attach to said first component inner surface and said second component inner surface by aligning said at least one outer ridge with said at least one gland.

6. The portable work platform system of claim 5 further comprising a cap attached on top of said railing, said cap having a width greater than the width of said railing, wherein said first spacer and second spacer are configured to fill the space between said cap and said railing.

7. The portable work platform system of claim 2, wherein said generally horizontal work platform further comprises an attachment point for a safety mechanism on said primary surface.

8. The portable work platform system of claim 2, wherein said first bottom ends and second bottom ends are secured to said first top surface and said second top surface respectively, by clevis mounts, said clevis mounts being fixed to said base support.

9. A system, comprising:

a boat having a railing and a wall, a portable work platform system configured to be removably mounted on said railing, the work platform system comprising:

a base support having a first base component, a second base component, a first top surface and a second top surface;

a clamping mechanism, said clamping mechanism connecting said first base component to said second base component and being configured to connect said base support to said railing;

at least two extendable support arm systems each having a first bottom end, a second bottom end, a first top end and a second top end, wherein each of said first bottom ends connect to said first top surface and each of said second bottom ends connect to said second top surface; and a generally horizontal work platform having a primary surface, a first bottom surface and a second bottom surface, wherein said first bottom surface connects to each extendable support arm systems' first top end, said second bottom surface connects to each extendable support arm systems' second top end and said primary surface being configured to support an individual to work on a surface of said boat.

10. The system of claim 9, wherein each extendable support arm system further comprises:

a primary extendable support link comprising said first bottom end, said first top end, a first support surface and a second support surface, wherein said first bottom end connects to said first top surface and said first top end connects to said first bottom surface;

a primary non-extendable support link comprising said second bottom end and a middle endpoint, wherein said second bottom end connects to said second top surface and said middle endpoint connects to said second support surface;

a secondary support link comprising a first endpoint and said second top end, wherein said first endpoint connects to said first support surface and said second top end connects to said second bottom surface.

11. The portable work platform system of claim 10, wherein each extendable support arm system further comprises a first hinge connecting said middle endpoint to said second support surface and a latch connecting said first endpoint to said first support surface.

12. The portable work platform system of claim 11, wherein said generally horizontal work platform further comprises a first platform component and a second platform component and a second hinge, wherein said first platform component is attached to said second platform component by the second hinge, the first hinge, the latch and the second hinge allowing said primary non-extendable support link, said secondary support link and said second platform component to fold adjacent to said primary extendable support link when detached from said base support.

13. The system of claim 10, wherein said base support comprises:

a first component inner surface and second component inner surface each having at least one gland on said inner surface;

a first detachable spacer and a second detachable spacer each having at least one flexible outer ridge, wherein said first detachable spacer and second detachable spacer are configured to attach to said first component inner surface and said second component inner surface by aligning said at least one outer ridge with said at least one gland.

14. The system of claim 13 further comprising a cap attached on top of said railing, wherein said cap has a width greater than the width of said railing, wherein said first spacer and second spacer are configured to fill the space between said cap and said outer railing.

15. The system of claim 14, wherein said generally horizontal work platform further comprises an attachment point for a safety mechanism on said primary surface.

16. The system of claim 10, wherein said first bottom ends and second bottom ends are secured to said first top surface and said second top surface respectively, by clevis mounts, said clevis mounts being fixed to said base support.

* * * * *